US005174373A

United States Patent [19]

Shinmura

[11] Patent Number: 5,174,373

[45] Date of Patent: Dec. 29, 1992

[54] HEAT EXCHANGER

[75] Inventor: Toshiharu Shinmura, Gunma, Japan

[73] Assignee: Sanden Corporation, Gunma, Japan

[21] Appl. No.: 730,075

[22] Filed: Jul. 15, 1991

[30] Foreign Application Priority Data

Jul. 13, 1990 [JP] Japan ..... 2-184044
Jul. 20, 1990 [JP] Japan ..... 2-190750

[51] Int. Cl.[5] ..... F28F 13/08

[52] U.S. Cl. ..... 165/176; 165/102; 165/146

[58] Field of Search ..... 165/174-176, 165/146, 147, 101, 102; 29/890.052

[56] References Cited

U.S. PATENT DOCUMENTS

| | | | |
|---|---|---|---|
| 2,612,349 | 9/1952 | Lintern | 165/96 X |
| 2,867,416 | 1/1959 | Lieberherr | 165/176 X |
| 4,201,263 | 5/1980 | Anderson | 165/146 |
| 4,274,477 | 6/1981 | Nikolic | 165/101 |
| 4,593,749 | 6/1986 | Schatz | 165/1 |
| 5,009,252 | 4/1991 | Halstead et al. | 165/140 |

FOREIGN PATENT DOCUMENTS

| | | | |
|---|---|---|---|
| 533157 | 9/1931 | Fed. Rep. of Germany | 165/102 |
| 63-3191 | 1/1988 | Japan | 165/176 |
| 913270 | 12/1962 | United Kingdom | 165/146 |

*Primary Examiner*—Allen J. Flanigan
*Attorney, Agent, or Firm*—Baker & Botts, L.L.P.

[57] ABSTRACT

A heat exchanger having a pair of header pipes and at least one of the header pipes including at least one dividing wall which extends in the longitudinal direction of the header pipe and divides the cavity of the header pipe into at least two chambers. A plurality of slots are longitudinally spaced along the header pipes. An inlet tube is connected to one of the header pipes. An outlet tube is also connected to one of the header pipes. A plurality of fluid tubes are disposed between the header pipes and each fluid tube has a plurality of partition walls for defining fluid paths in fluid communication with the header pipes through the slots. A plurality of corrugated fins are disposed between opposed surfaces of the fluid tubes. Thus, the heat-exchanging efficiency of the heat exchanger increases and, in addition, the heat exchanger is able to balance the amount of the heat-exchanging and the pressure loss.

37 Claims, 17 Drawing Sheets

HEAT EXCHANGER

TECHNICAL FIELD

The present invention relates generally to heat exchangers, and more particularly, to a heat exchanger including header pipes each provided with at least one dividing wall to divide the interior of the header pipe into at least two chambers.

BACKGROUND OF THE INVENTION

With reference to FIGS. 2 and 3, one prior art embodiment of a heat exchanger is shown. Condenser includes a plurality of adjacent, essentially flat tubes 3 having an oval cross-section and open ends which allow refrigerant fluid to flow therethrough. Flat tubes 3 are fixedly connected to header pipes 2*a* and 2*b*, respectively and have a plurality of fluid paths 9 formed by a plurality of partitions 8. Partition wall 7 is disposed in header pipe 2*a* so as to divide its interior into upper and lower cavities. Inlet pipe 5 is connected to the upper portion of the upper cavity and outlet pipe 6 is connected to the lower portion of the lower cavity.

In operation, compressed refrigerant gas from an external compressor coupled to inlet pipe 5 flows into the upper cavity of header pipe 2*a* through the inlet pipe, and is distributed so that a portion of the gas flows through each of flat tubes 3 which is disposed above the location of partition wall 7, and into the upper cavity of header pipe 2*b*. Thereafter, the refrigerant in the upper cavity of header pipe 2*b* flows downwardly into the lower cavity thereof, and is distributed so that a portion of the refrigerant flows through each of flat tubes 3 disposed below the location of partition wall 7, and into the lower cavity of header pipe 2*a*. As the refrigerant gas sequentially flows through flat tubes 3, heat from the refrigerant gas is exchanged with the atmospheric air flowing through corrugated fin units 4. The condensed liquid refrigerant in the lower cavity of header pipe 2*a* flows out of the cavity through outlet pipe 6 and into an external receiver coupled to the header pipe.

Referring further to FIG. 4, the temperature of the refrigerant flowing through each flow path 9 of flat tubes 3 and the temperature of the heat-exchanging air is shown in relation to the distance from the windward side of the heat-exchanging air is shown.

Since the refrigerant in fluid paths 91 at the windward side is heat-exchanged with the heat-exchanging air which has not yet been used for heat exchanging, i.e., the air is at a low temperature, there is a large temperature difference between the temperature of the refrigerant and the temperature of the heat-exchanging air. Accordingly, the heat-exchanging efficiency of the condenser at the windward side becomes high. On the other hand, since the refrigerant in fluid paths 92 at the leeward side is heat-exchanged with the heat-exchanging air which has already been used for heat-exchanging, i.e., the air is at a relatively high temperature, there is not a large temperature difference between the temperature of the refrigerant and the temperature of the heat-exchanging air. Accordingly, the heat-exchanging efficiency of the condenser on the leeward side decreases.

As mentioned above, there is a large difference in the amount of heat-exchanging occurring on the windward side and on the leeward side of the heat exchanger and, thus, the total amount of heat-exchanging in such a conventional heat exchanger becomes small.

In addition, since the efficiency of a heat exchanger is determined by the amount of heat-exchanging and the pressure loss in the heat exchanger, when the amount of heat-exchanging is large and the pressure loss within the heat exchanger is small, the efficiency of the heat exchanger is improved. However, the amount of heat-exchanging and the pressure loss are directly proportional to each other. If the amount of heat exchanging becomes large, the pressure loss also becomes large. Accordingly, although the heat exchanger is designed so that the amount of the heat-exchanging and the pressure loss can be balanced, since the pressure of the refrigerant gas discharged from a compressor in an automotive air conditioning system and the rotational speed of the compressor are changed according to the driving condition of the automobile, it is very difficult to balance the amounts of heat-exchanging and pressure loss.

SUMMARY OF THE INVENTION

It is a primary object of the present invention to provide a heat exchanger of which the heat-exchanging efficiency is high.

It is another object of the present invention to provide a heat exchanger which can balance the amount of the heat-exchanging and the pressure loss.

A heat exchanger according to the present invention comprises a pair of header pipes. At least one of the header pipes includes at least one dividing wall which extends in the longitudinal direction of the header pipe for dividing the cavity of the header pipe into at least two chambers. A plurality of slots are spaced out on the header pipes in the longitudinal direction of each of the header pipes. An inlet tube is connected to one of the header pipes. An outlet tube is connected to one of the header pipes. A plurality of fluid tubes are disposed between the header pipes and each fluid tube has a plurality of partition walls for defining fluid paths in fluid communication with the header pipes through the slots. A plurality of corrugated fins are disposed between opposed surfaces of the fluid tubes.

Further objects, features and other aspects of the present invention will be understood from the detailed description of the preferred embodiment of the invention with reference to the annexed drawings.

BRIEF DESCRIPTION OF THE DRAWINGS

FIG. 5(*b*) is a perspective view illustrating a connecting portion between a header pipe and a flat tube in accordance with another embodiment of this invention.

DETAILED DESCRIPTION OF THE PREFERRED EMBODIMENTS

Figure 1:
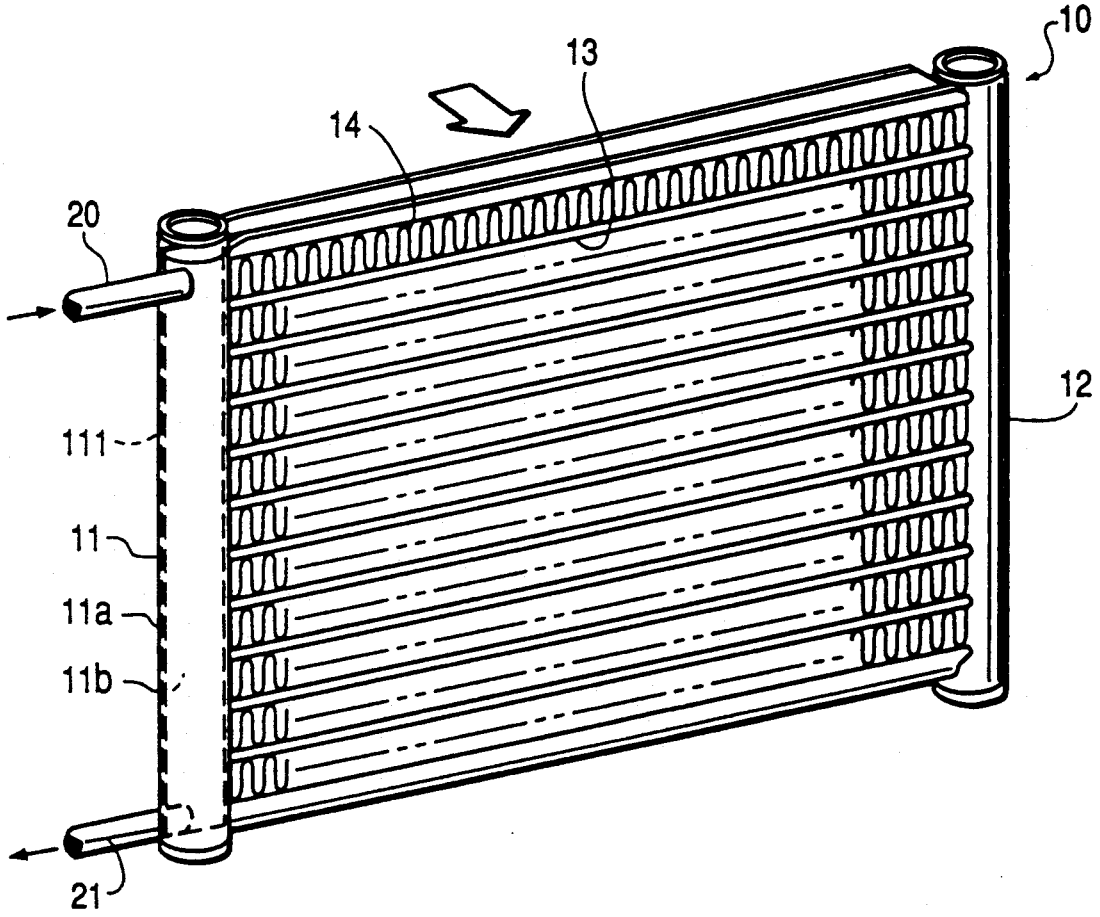
FIG. 1 is a perspective view of a condenser in accordance with one embodiment of this invention.
Figure 2:
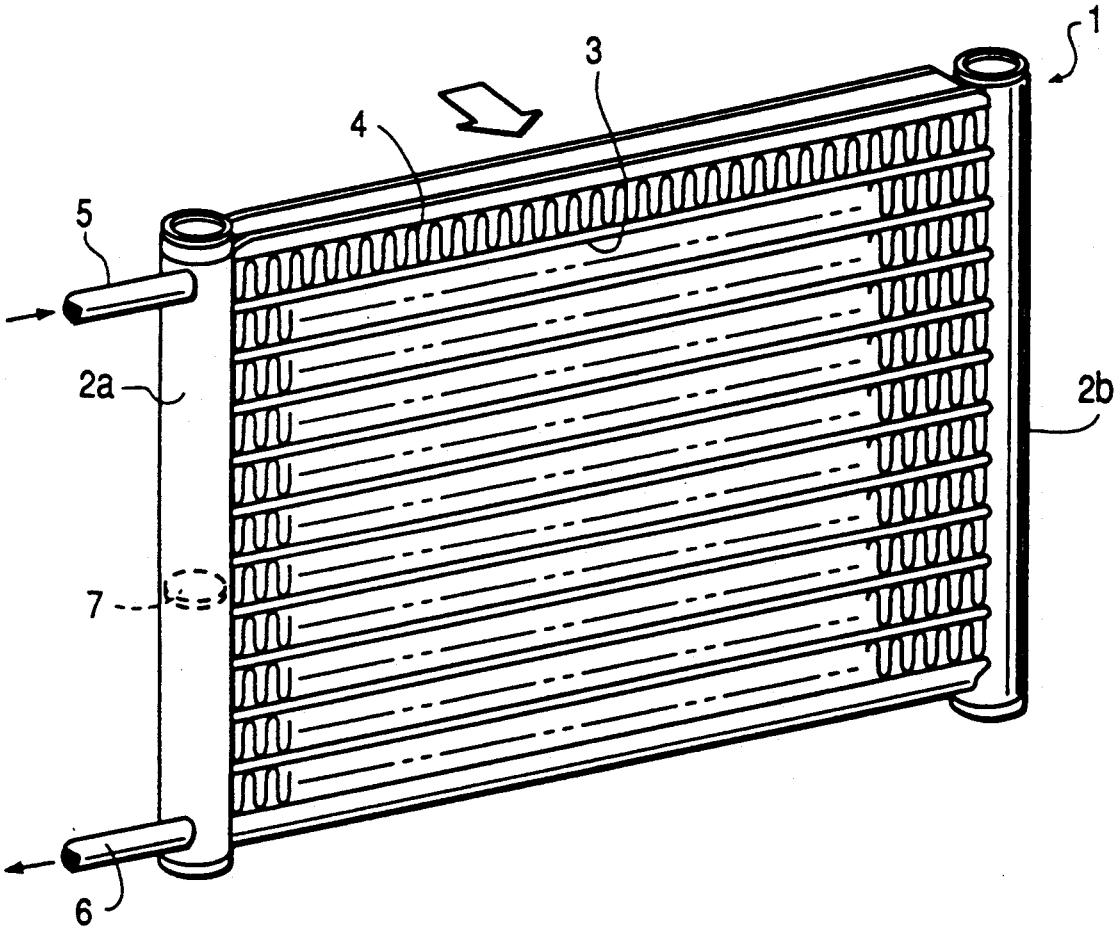
FIG. 2 PRIOR ART
FIG. 2 is a perspective view of a prior art condenser.
Figure 3:
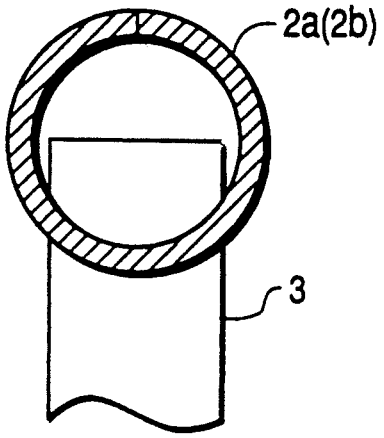
FIG. 3 PRIOR ART
FIG. 3 is a cross-sectional view of a header pipe as shown in FIG. 2.

With reference to FIGS. 1 and 5–7, the construction of a heat exchanger, and in particular, a condenser in accordance with the first embodiment of the present invention is shown.

Condenser 10 includes a pair of header pipes 11 and 12, a plurality of flat tubes 13, which are disposed between header pipes 11 and 12, and corrugated fins 14, which are disposed between flat tubes 13. The interior of header pipe 11 is divided by a dividing wall 111 into first and second chambers 11*a* and 11*b*, dividing wall 111 extending in the longitudinal direction of header pipe 11. The interior of header pipe 12 is not divided with any dividing wall. Dividing wall 111 is disposed in header pipe 11 so that its planar surface is subject to the particular direction of the air flow. First chamber 11*a* is disposed to be leeward of second chamber 11*b* in the direction of the air flow. Inlet tube 20 is connected to the upper cavity portion of first chamber 11*a* of header pipe 11. Outlet tube 21 is also connected to the lower cavity of second chamber 11*b* of header pipe 11. Both ends of flat tubes 13 are connected to header pipes 11 and 12 through slots 112 and 122, respectively.

Figure 5A:
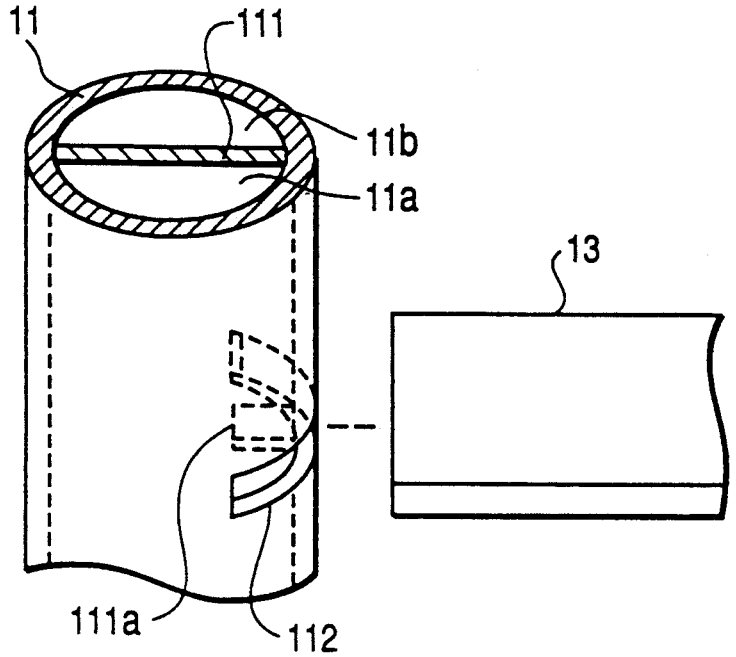
FIG. 5(*a*) is a perspective view illustrating a connecting portion between a header pipe and a flat tube in accordance with one embodiment of this invention.
Figure 5B:
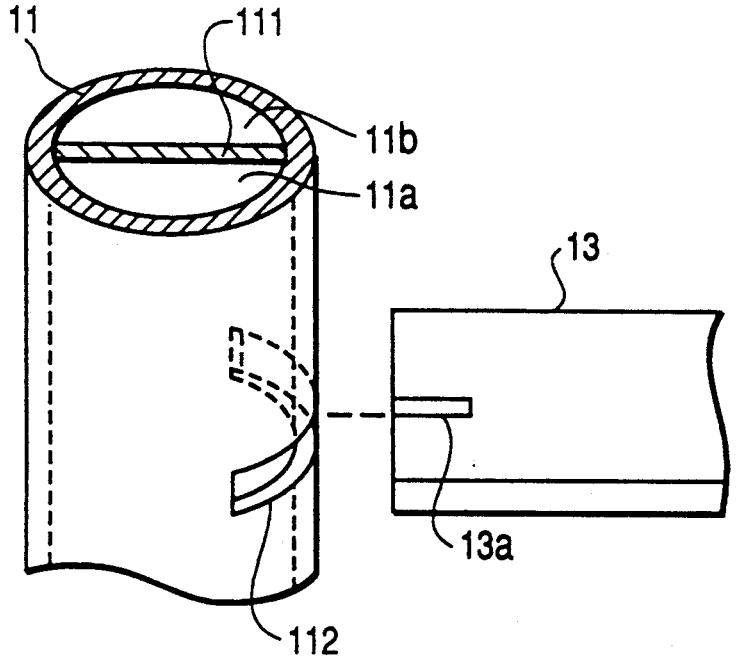
Figure 6A:
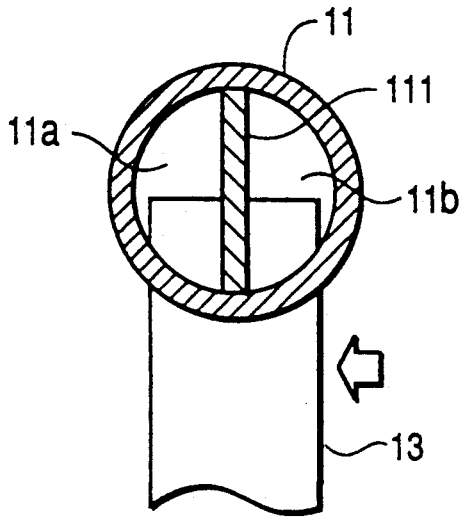
FIGS. 6(*a*)–6(*g*) are, respectively, cross-sectional views of a header pipe made in accordance with various embodiments of this invention.
Figure 6B:
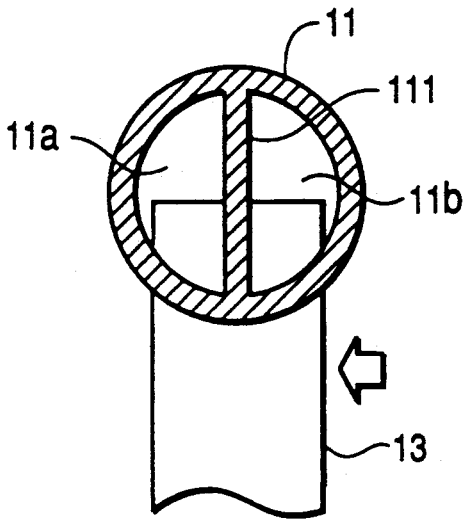
Figure 6C:
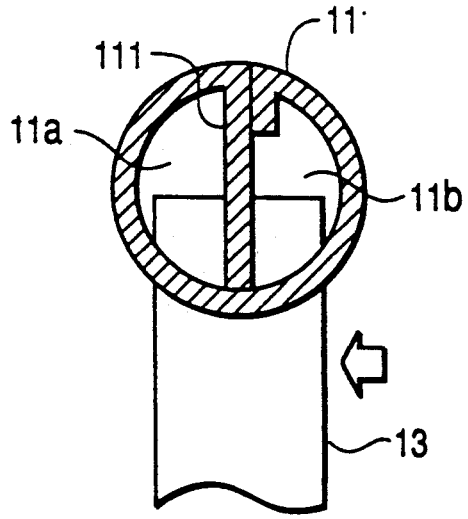
Figure 6D:
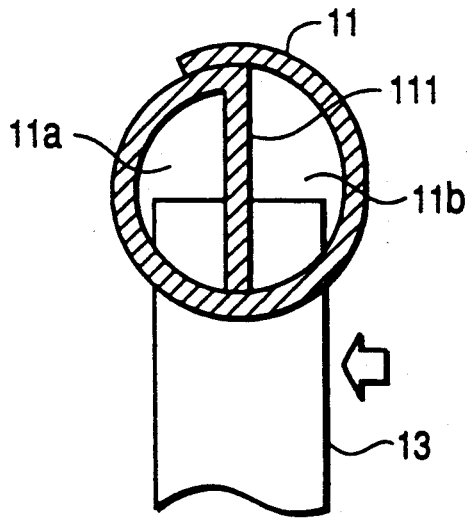
Figure 6E:
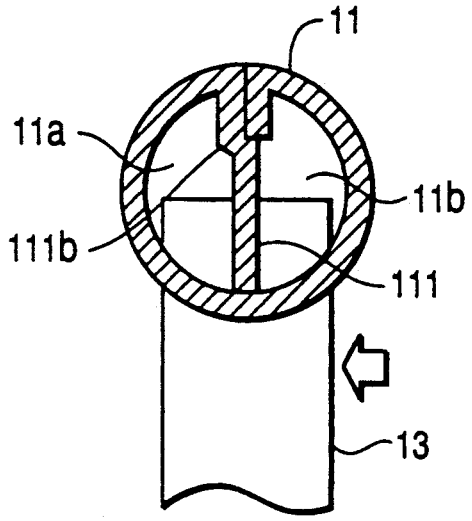
Figure 6F:
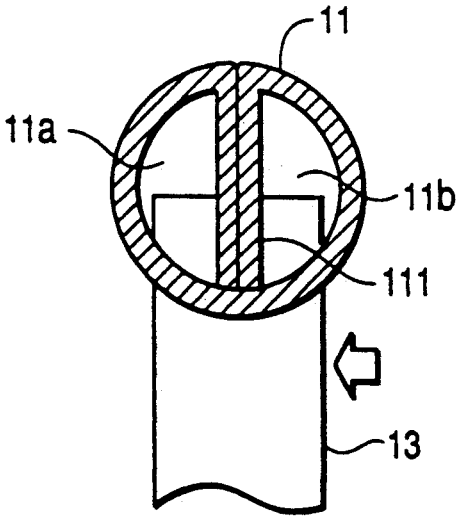
Figure 6G:
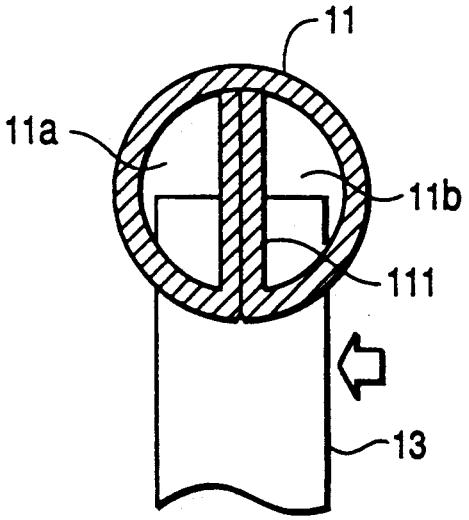
Figure 7A:
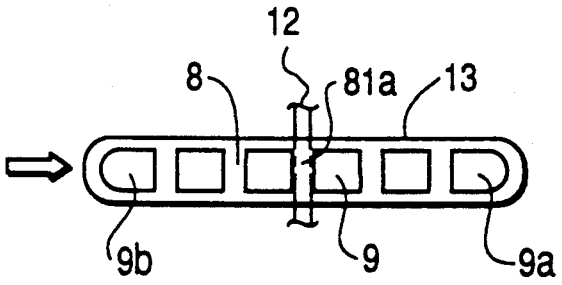
FIGS. 7(*a*)–7(*d*) are, respectively, cross-sectional views of a flat tube made in accordance with various embodiments of this invention.
Figure 7B:
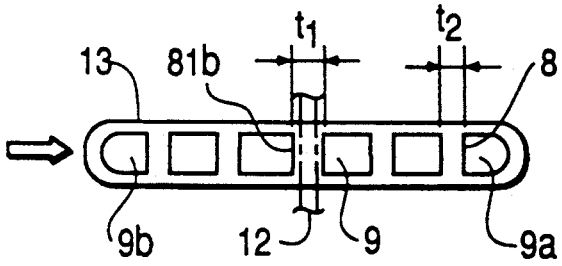
Figure 7C:
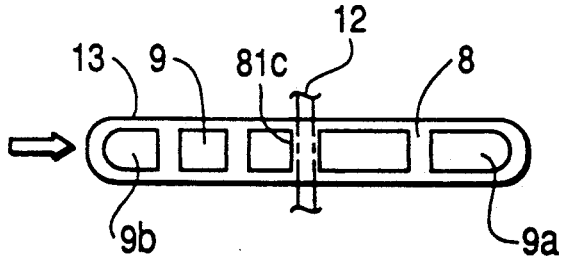
Figure 7D:
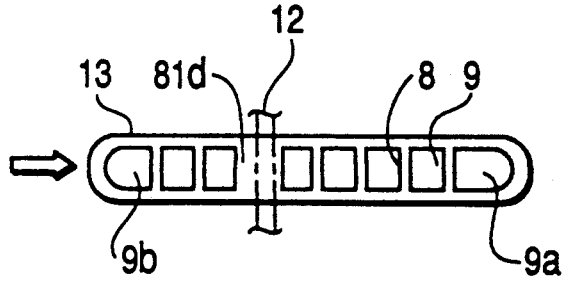

With reference to FIG. 5(*a*), cut-out portion 111*a* is formed on the side portion of dividing wall 111 at a position corresponding to slot 112 and to receive the ends of flat tubes 13. Another construction of the connecting portion of header pipe 11 and flat tubes 13 is shown in FIG. 5(*b*). In this embodiment, slits 13*a* are formed on the ends of flat tubes 13 and receive the peripheral surfaces of dividing wall 111.

With reference to FIGS. 6(*a*)–6(*g*), a plurality of construction embodiments for the header pipes and the dividing walls are shown. Dividing wall 111 as shown in FIG. 6(*a*) is inserted into the interior of header pipe 11 and is fixed to header pipe 11 with welding. Dividing wall 111 and header pipe 11 as shown in FIG. 6(*b*) are integrally formed by a protrusion process. Dividing wall 111 as shown in FIGS. 6(c)–6(*g*) are respectively formed by bending the end of the header pipe material.

Referring to FIG. 6(*c*), the header pipe material is bent in an annular formation, with the exception of one end portion which is used to form dividing wall 111 and the terminal end of which is welded to the inner surface of the annularly bent portion. The other end portion of the annularly bent portion is bent inwardly of header pipe 11 and is welded to a peripheral surface of dividing wall 111.

Referring to FIG. 6(*d*), one end of the header material is used as dividing wall 111 and is bent similar to that of FIG. 6(*c*). In this instance, however, the end of the annularly bent portion extends onto and overlays the annularly bent portion and is welded to the outer surface thereof.

Referring to FIG. 6(*e*), the header pipe material is bent in an annular formation with one end portion forming a dividing wall 111, and the terminal end of the end portion being welded to the inner surface of the annularly bent portion. A step-like portion 111*b* is formed on dividing wall 111. The end of the annularly bent portion is further bent inwardly of header pipe 11 and is welded to the outer surface of the concave portion of step-like portion 111*b*.

Referring to FIG. 6(*f*), the header pipe material is bent in a generally annular formation except that both end portions are bent to face toward the end of flat tube 13. The outer surfaces of the end portions contact and are welded to one other. In this embodiment, both end portions are used to form dividing wall 111.

Referring to FIG. 6(*g*), the header pipe material is bent in a generally annular formation except that both end portions are bent to extend out from the end of flat tube 13. The outer surfaces of the end portions contact and are welded to each other. In this embodiment, both end portions are also used to form dividing wall 111.

With reference to FIGS. 7(*a*)–7(*d*), the construction for a plurality of flat tubes are shown.

Referring to FIG. 7(*a*), the thickness of partition walls 8 to each respective flow path 9 is respectively equal, which is a little greater than the side edge thickness of dividing wall 111. The cross-sectional area of each flow path 9 is also respectively equal. Central partition wall 81*a* sealingly contacts the side portion of dividing wall 111 to partition flow paths between at windward side and at leeward side.

Referring to FIG. 7(*b*), central partition wall 81*b* is formed so that its thickness $t_1$ is greater than thickness $t_2$ of the other partition walls 8 and is greater than the thickness of portion wall 81*a*. The cross-sectional area of each flow path 9 is respectively equal. Since the thickness of central partition wall 81*b* is greater than the thickness of partition wall 81*a*, it becomes easier to assemble dividing wall 111 with flat tubes 13 in a manner such that dividing wall 111 partitions the flow paths between flow paths on a windward side and on a leeward side.

Referring to FIG. 7(*c*), central partition wall 81*c* is formed so that its thickness $t_1$ is greater than thickness $t_2$ of the other partition walls 8. The cross-sectional area of each flow path 9*a* on the leeward side is greater than that of each flow path 9*b* on the windward side. In this construction, the amount of flow of the refrigerant flowing through flow paths 9a on the leeward side can be increased with a small pressure loss.

In addition, referring to FIG. 7(*d*), central partition wall 81d is also formed so that its thickness $t_1$ is greater than thickness $t_2$ of the respective other partition walls 8. The cross-sectional area of each flow path 9 is respectively equal. Since the number of flow paths 9a on the leeward side is larger than that of flow paths 9b on the windward side, the total cross-sectional area of flow paths 9a on the leeward side is greater than that of flow paths 9b on the windward side. According to this construction, although its pressure loss is increased relative to that of flow paths 9a on the leeward side, as shown in FIG. 7(*c*), the area of the heat-exchanging parts is largely increased.

Figure 8:
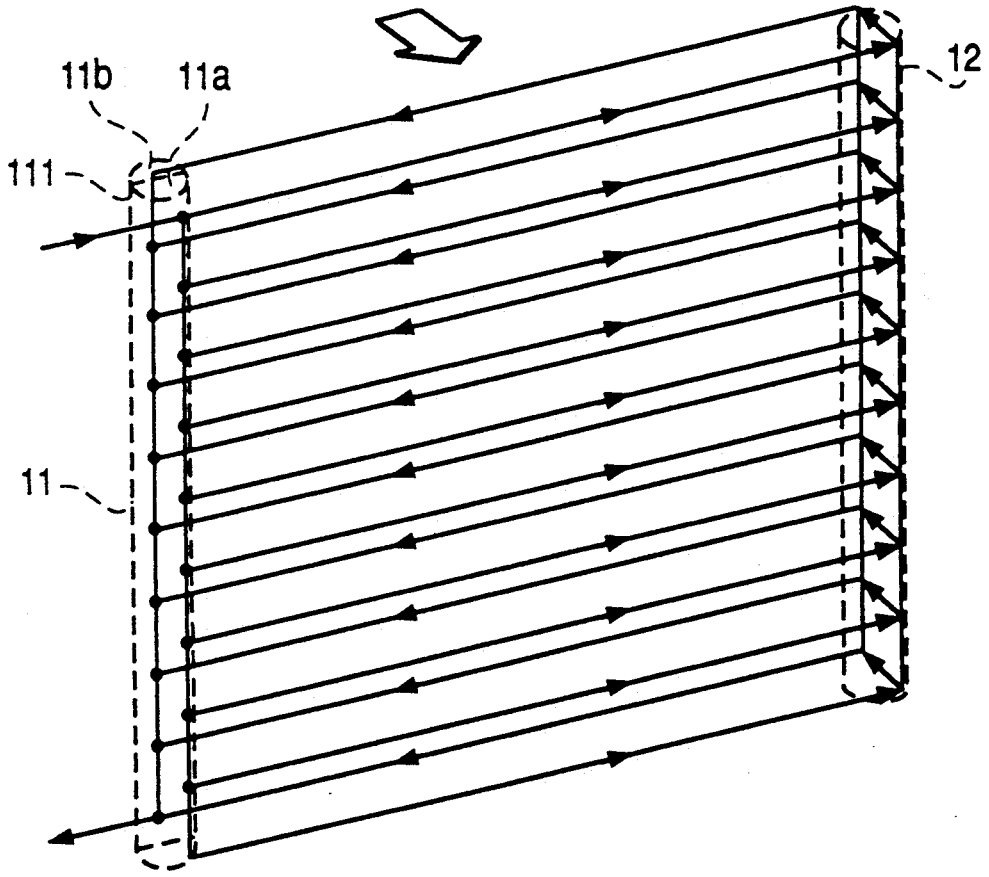
FIG. 8 is an illustrative view of the flow of the refrigerant in a condenser as shown in FIG. 1.

Referring to FIG. 8, in operation, compressed refrigerant gas from an external compressor coupled to inlet tube 20 flows into the upper cavity of first chamber 11a of header pipe 11 through inlet tube 20, and is distributed into each flat tube 13, which has a plurality of flow paths 9, and then flows into the cavity of header pipe 12 through flow paths 9a on the leeward side. Thereafter, the refrigerant gas mixed with liquid turns around in header pipe 12 and flows into the cavity of second chamber 11b of header 11 through flow paths 9b in flat tubes 13 on the windward side. The refrigerant flows downwardly into the lower cavity of second chamber 11b and flows out of header pipe 11 through outlet tube 21.

Figure 9:
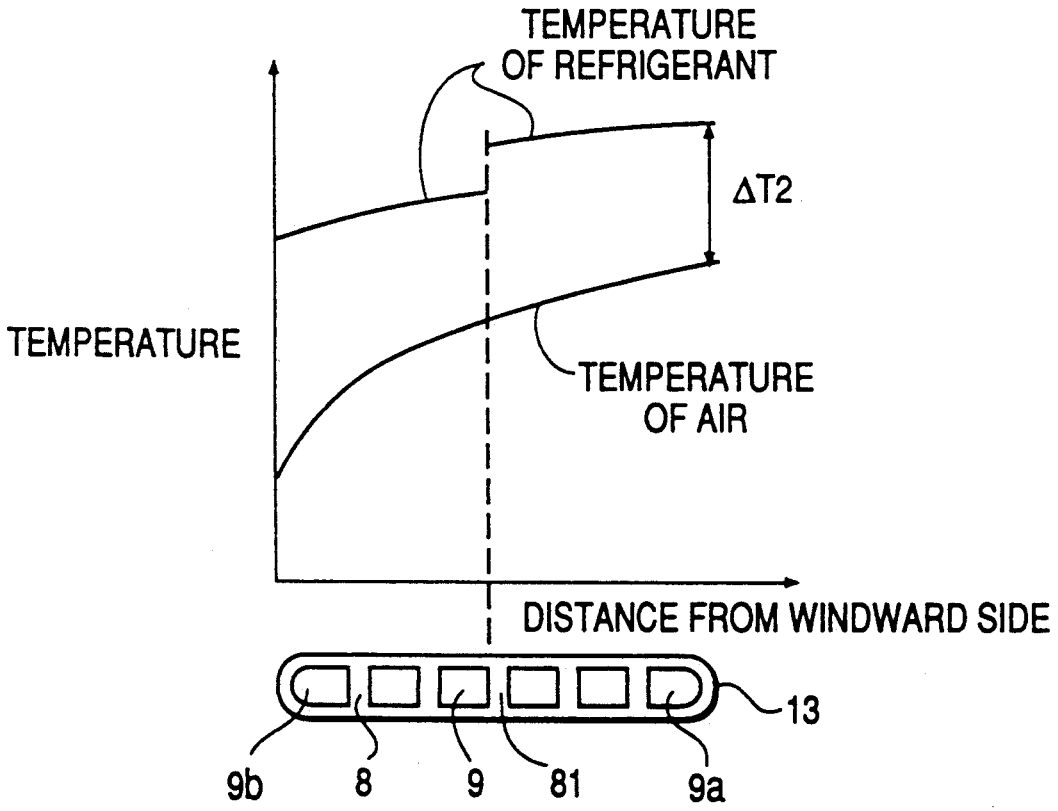
FIG. 9 is a graph illustrating the temperature of the refrigerant flowing through each flow path of a flat tube and the temperature of the heat-exchanging air in relation to the distance from the windward side of the heat-exchanging air in a condenser as shown in FIG. 1.

With reference to FIG. 9, the temperature of the refrigerant flowing through each flow path 9 of flat tube 13 and the temperature of the heat-exchanging air in relation to the distance from the windward side of the heat-exchanging air is shown.

As the heat-exchanging air flows through corrugated fin units 14 from the windward side of flat tubes 13 to the leeward side thereof, the heat-exchanging air absorbs the heat of the refrigerant flowing through flow paths 9, and its temperature gradually increases. On the other hand, since the refrigerant first flows from the external source into flow paths 9a of flat tubes 13 on the leeward side, the temperature of the refrigerant flowing through flow paths 9a on the leeward side is greater than that of the refrigerant flowing through flow paths 9b on the windward side.

Figure 4:
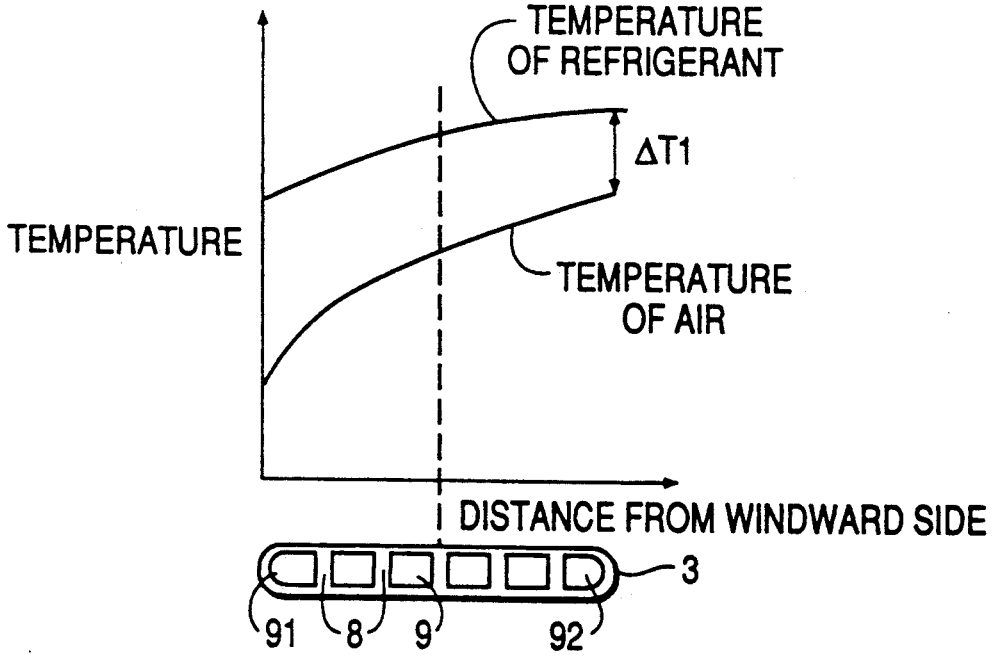
FIG. 4 PRIOR ART
FIG. 4 is a graph illustrating the temperature of the refrigerant flowing through each flow path of a flat tube and the temperature of the heat-exchanging air in relation to the distance from the windward side of the heat-exchanging air in a condenser as shown in FIG. 2.

Accordingly, on the leeward side, the temperature of the heat-exchanging air becomes high and the temperature of the refrigerant also becomes high, relative to the temperature of the refrigerant in the prior art as shown in FIG. 4. Temperature difference $T_2$ between the temperature of the heat-exchanging air and the temperature of the refrigerant on the leeward side is thus greater than temperature difference $T_1$ in the prior art, and the efficiency o the heat-exchanging of condenser 10 on the leeward side is prevented from decreasing.

In addition, the temperature of the refrigerant on the windward side becomes low, relative to that shown in FIG. 4, since the refrigerant has already been heat-exchanged on the leeward side. However, since the heat-exchanging air has not yet been used for heat exchanging, i.e., the air is at a low temperature, the temperature difference between the temperature of the heat-exchanging air and the temperature of the refrigerant is enough to provide a sufficient heat-exchange. Thus, the heat-exchanging efficiency of condenser 10 is improved relative to the prior art condenser.

Figure 10:
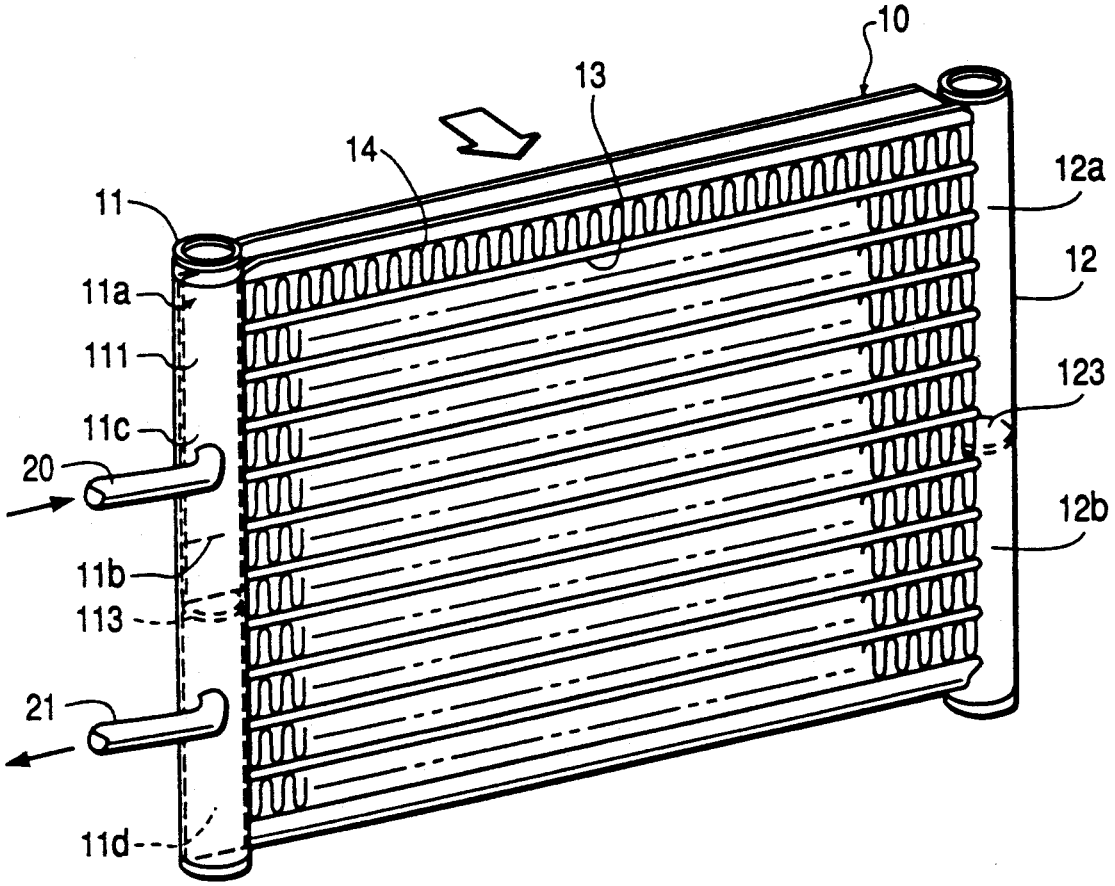
FIG. 10 is a perspective view of a condenser in accordance with another embodiment of this invention.

With reference to FIG. 10, the construction of a condenser in accordance with a second embodiment of the present invention is shown.

In this embodiment, condenser 10 includes a pair of header pipes 11 and 12, a plurality of flat tubes 13, which are disposed between header pipes 11 and 12, and corrugated fins 14, which are disposed between flat tubes 13. As shown in FIG. 10, t he interior of header pipe 11 is first divided by dividing wall 111 into first and second chambers 11a and 11b, dividing wall 111 extending the longitudinal direction of header pipe 11. First chamber 11a is then divided by partition wall 113 disposed perpendicular to the longitudinal direction of header pipe 11, to form third and fourth chambers 11c and 11d. Third chamber 11c is disposed above fourth chamber 11d. The cavity of header pipe 12 is divided by partition wall 123 into fifth and sixth chambers 12a and 12b. Dividing wall 111 is disposed in header pipe 11 so that its planar surface is subject to the particular direction of the air flow. Inlet tube 20 is connected to third chamber 11c of header pipe 11. Outlet tube 21 is connected to fourth chamber 11d of header pipe 11. Both ends of flat tubes 13 are connected to header pipes 11 and 12 through slots 112 and 122, respectively.

Figure 11:
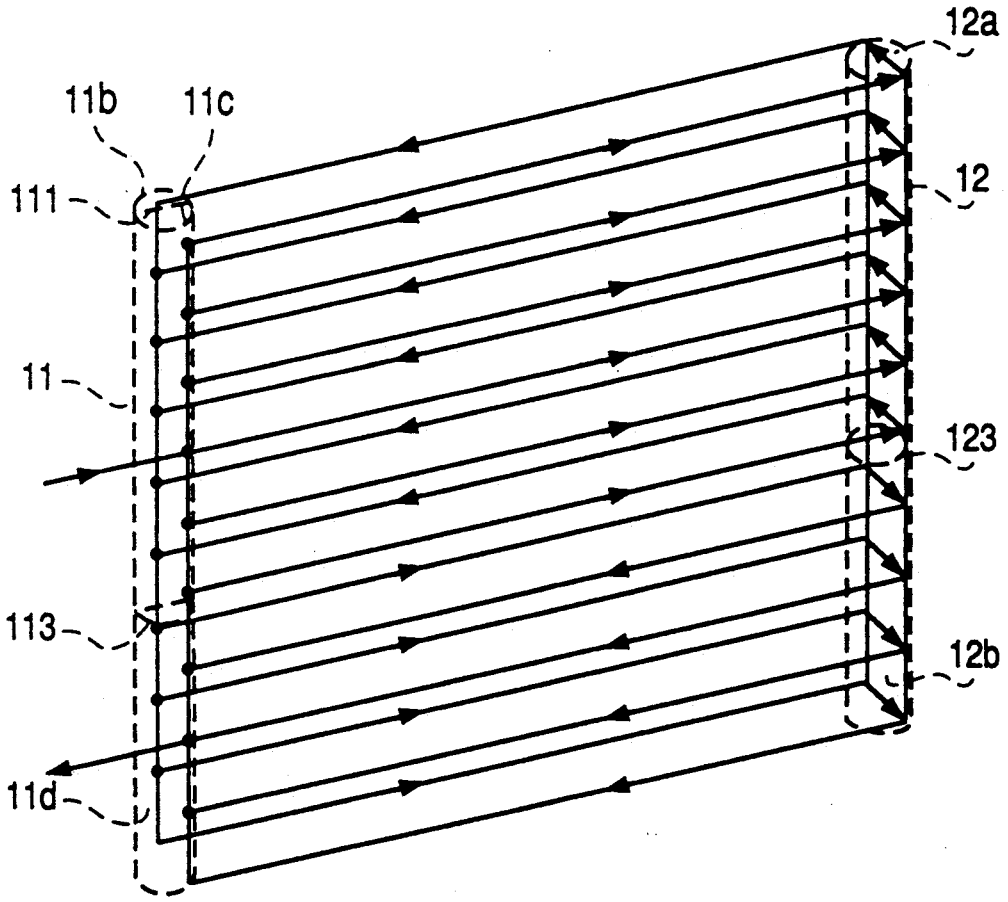
FIG. 11 is an illustrative view of the flow of the refrigerant in a condenser as shown in FIG. 10.

In operation, referring to FIG. 11, compressed refrigerant gas from an external compressor coupled to inlet tube 20 flows into third chamber 11c of header pipe 11 through inlet tube 20, and is distributed into each flat tube 13 which has a plurality of flow paths 9 and then flows into fifth chamber 12a, which is the upper cavity of header pipe 12, through flow paths 9a on the leeward side. Thereafter, the refrigerant gas mixed with liquid turns around in fifth chamber 12a and flows into flow paths 9b of flat tubes 13 on the windward side. The refrigerant flows into the upper cavity of second chamber 11b through flow paths 9b and flows downwardly into the lower cavity of second chamber 11b, and thereafter flows into sixth chamber 12b, which is the lower cavity of header pipe 12, through flow paths 9b on the windward side. The refrigerant further turns around in sixth chamber 12b and flows into fourth chamber 11d of header pipe 11 through flow paths 9a on the leeward side, and flows out of fourth chamber 11d through outlet tube 21.

Figure 12:
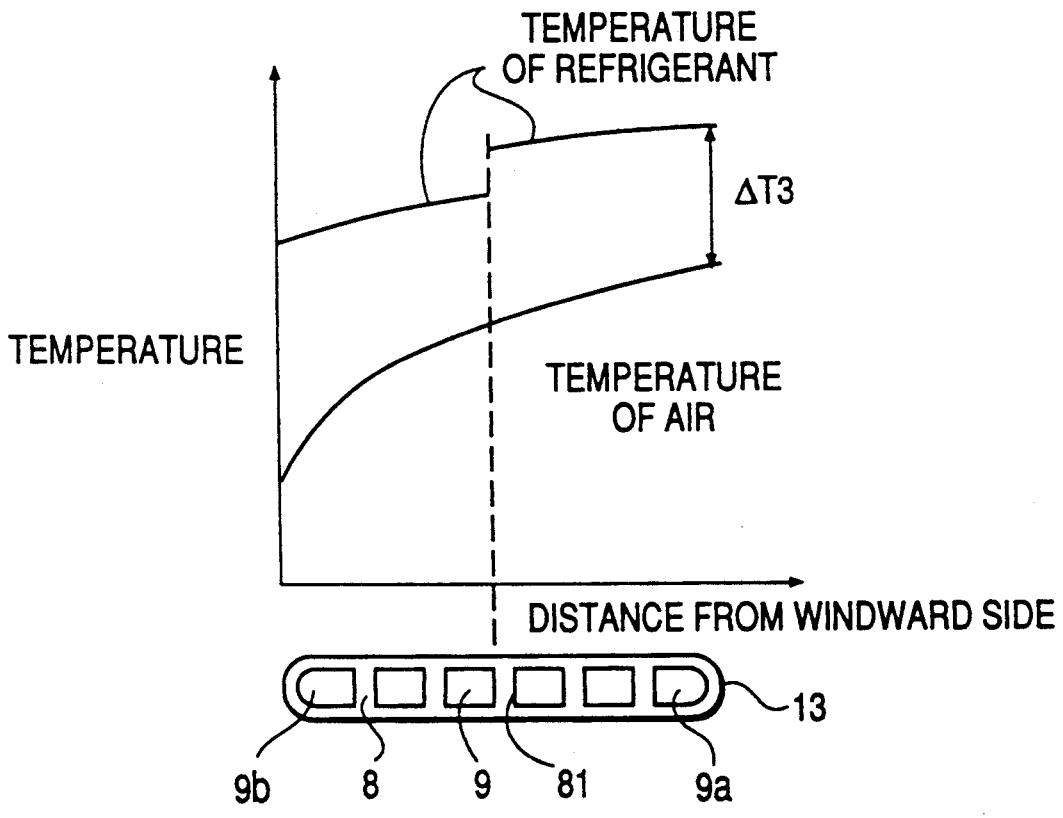
FIG. 12 is a graph illustrating the temperature of the refrigerant flowing through each flow path of a flat tube and the temperature of the heat-exchanging air in relation to the distance from the windward side of the heat-exchanging air in a condenser as shown in FIG. 10.

With reference to FIG. 12, the temperature of the refrigerant flowing through each flow path 9 of flat tube 13 and the temperature of the heat-exchanging air at the upper portion of the condenser, i.e., at the position above partition wall 113 and 123, is shown in relation to the distance from the inlet side, i.e. the windward side, of the heat-exchanging air.

As the heat-exchanging air flows through corrugated fin units 14 from the windward side of flat tubes 13 to the leeward side thereof, the heat-exchanging air absorbs the heat of the refrigerant flowing through flow paths 9, and its temperature gradually increases. On the other hand, since the refrigerant first flows from the external source into flow paths 9a of flat tubes 13 on the leeward side, the temperature of the refrigerant flowing through flow paths 9a on the leeward side is greater than that of the refrigerant flowing through flow paths 9b on the windward side.

Accordingly, on the leeward side, the temperature of the heat-exchanging air becomes high and the temperature of the refrigerant also becomes high relative to the temperature of the refrigerant in the prior art shown in FIG. 4. Temperature difference $T_3$, as defined between the temperature of the refrigerant flowing through on the leeward side and the temperature of the heat-exchanging air, is greater than the temperature difference $T_1$ in the prior art. The efficiency of the heat-exchanging of the prior art condenser does not contribute to its condensation because the refrigerant flowing therethrough is not completely heat exchanged and is therefore not changed into a liquid state. However, in the present invention, since the refrigerant is cooled to a certain temperature by flowing through the upper portion of the condenser, the refrigerant is completely condensated in the condenser at the lower portion of the condenser. Thus, the heat-exchanging efficiency can be improved.

Figure 13:
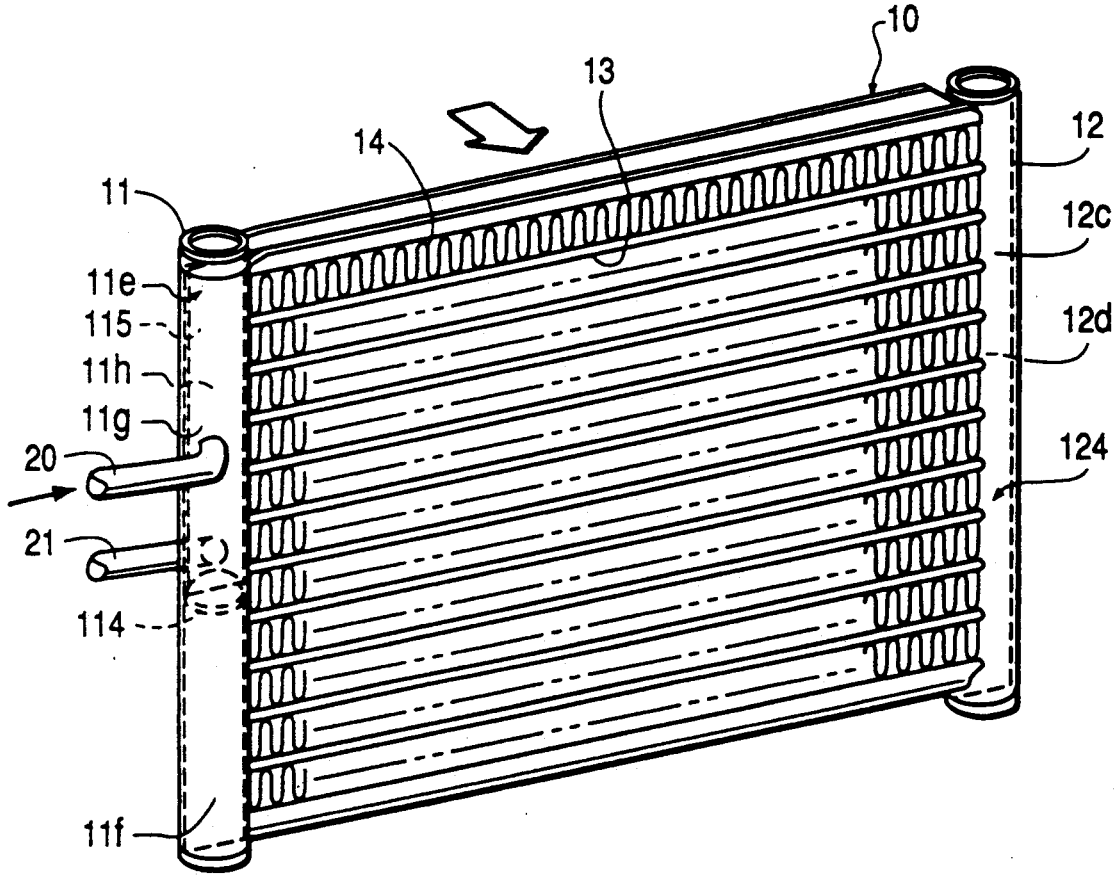
FIG. 13 is a perspective view of a condenser in accordance with still another embodiment of this invention.

With reference to FIG. 13, the construction of a condenser in accordance with a third embodiment of the present invention is shown.

In this embodiment, condenser 10 includes a pair of header pipes 11 and 12, a plurality of flat tubes 13, which are disposed between header pipes 11 and 12, and corrugated fins 14, which are disposed between flat tubes 13. As shown in FIG. 13, the cavity of header pipe is divided by partition wall 114 into seventh and eighth chambers 11*e* and 11*f*. Seventh chamber 11*e* is divided by dividing wall 115, which extends in the longitudinal direction of header pipe 11, into ninth and tenth chambers 11*g* and 11*h*. The cavity of header pipe 12 is divided with dividing wall 124, which extends in the longitudinal direction of header pipe 12, into eleventh and twelfth chambers 12*c* and 12*d*. Inlet tube 20 is connected to ninth chamber 11*g* of header pipe 11. Both ends of flat tubes 13 are connected to header pipes 11 and 12 through slots 112 and 122, respectively.

Figure 14:
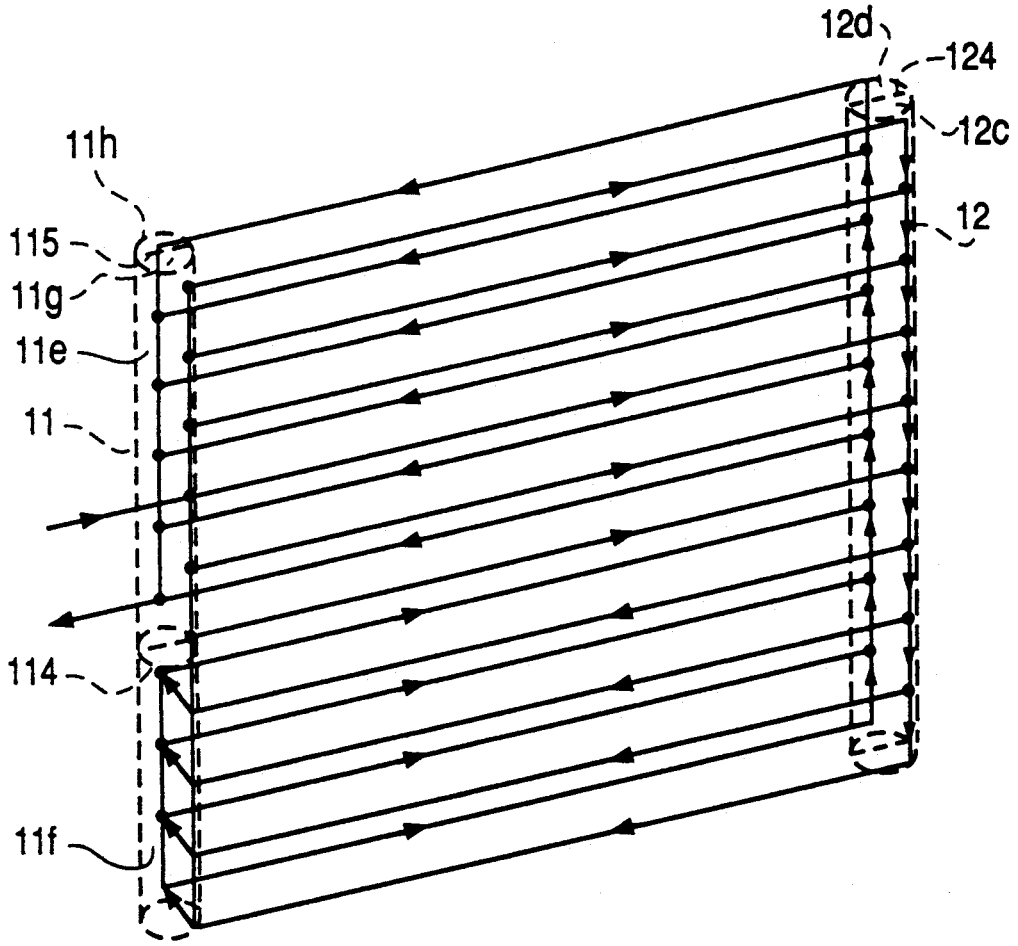
FIG. 14 is an illustrative view of the flow of the refrigerant in a condenser as shown in FIG. 13.

In operation, referring to FIG. 14, compressed refrigerant gas from an external compressor coupled to inlet tube 20 flows into ninth chamber 11*g* of header pipe 11 through inlet tube 20, and is distributed into each flat tubes 13 which has a plurality of flow paths 9, and then flows into the upper cavity of eleventh chamber 12*c* through flow paths 9*a* on the leeward side. The refrigerant gas mixed with liquid flows downwardly into the lower cavity of eleventh chamber 12*c* and flows into flow paths 9*a* of flat tubes 13 on the leeward side. The refrigerant flows thereafter into eighth chamber 11*f*, turns around in eight chamber 11*f* and flows into flow paths 9*b* of flat tubes 13 on the windward side. Then, the refrigerant flows into the lower cavity of twelfth chamber 12*d* on the windward side, flows upwardly into the upper cavity of twelfth chamber 12*d* and flows into flow paths 9*b* of flat tubes 13. Thereafter, the refrigerant flows into tenth chamber 11*h*, which is the upper and windward cavity of header pipe 11, through flow paths 9*b* on the windward side. The refrigerant flows out of tenth chamber 11*h* through outlet tube 21.

As mentioned above, the refrigerant first flows through flow paths 9*a* of flat tubes 13 on the leeward side and then flows through flow paths 9*b* of flat tubes 13 on the windward side. The relationship of the temperature of the refrigerant flowing through each flow path 9 of flat tubes 13 and the inlet side of the heat-exchanging air to the distance from the inlet side of the heat-exchanging air is thus the same as shown in FIG. 12.

Figure 15:
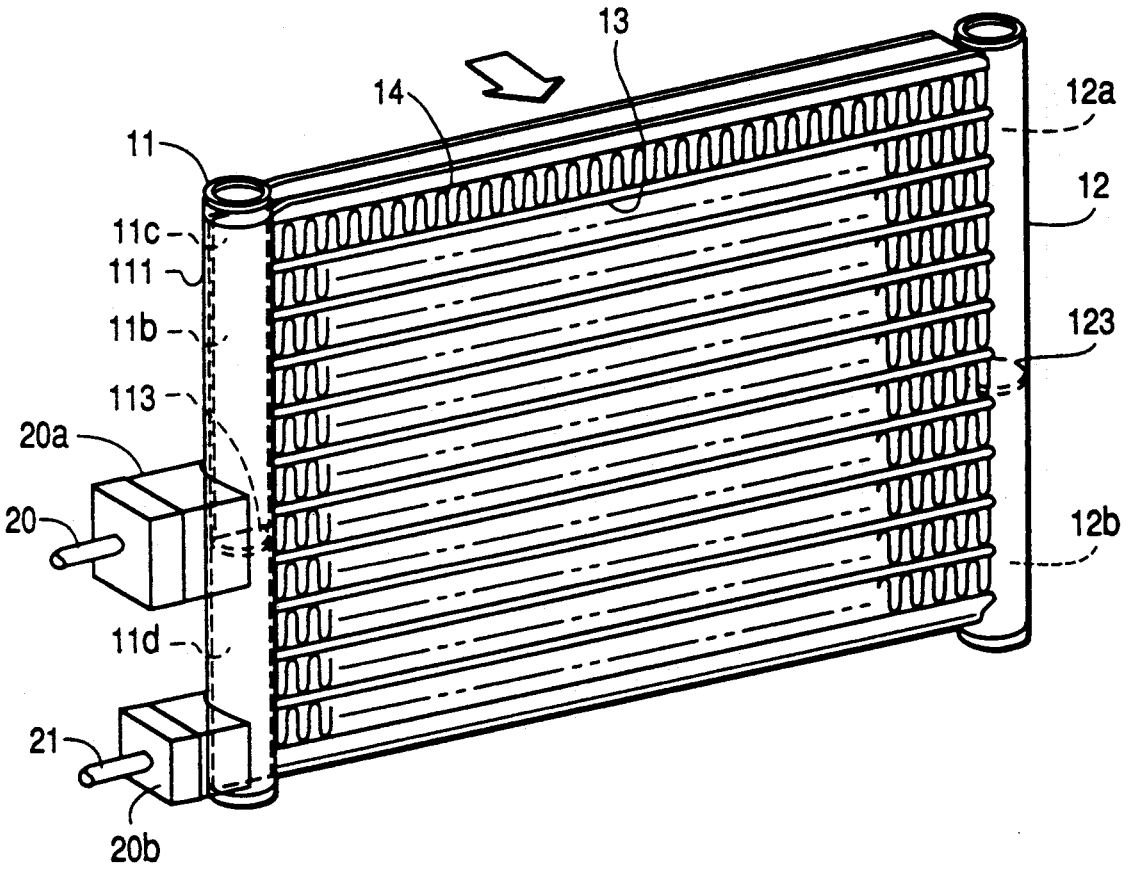
FIG. 15 is a perspective view of a condenser in accordance with still another embodiment of this invention.

With reference to FIG. 15, the construction of a condenser in accordance with a fourth embodiment of the present invention is shown.

Inlet tube 20, as also shown in the second embodiment of the present application, is connected to header pipe 11 of the condenser through holder 20*a* and outlet tube 21 is also connected to header pipe 11 thereof through holder 21*a*. Since the other construction features of this embodiment are the same as those shown in FIG. 10, a detailed description of the construction of the condenser is omitted.

Figure 16:
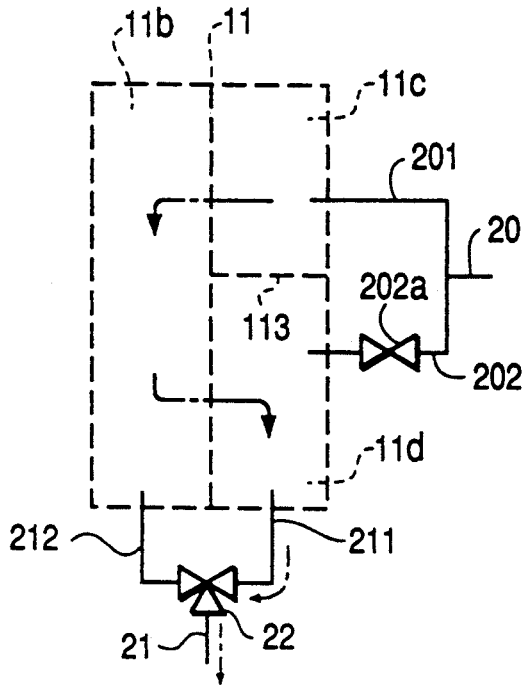
FIG. 16 is an illustrative view of a refrigerant flow circuit in a condenser, as shown in FIG. 15, at the normal operation of a compressor.
Figure 17:
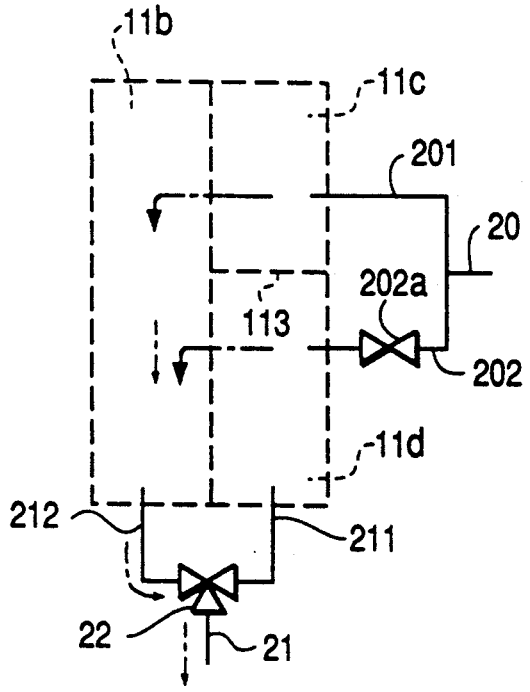
FIG. 17 is an illustrative view of a refrigerant flow circuit in a condenser, as shown in FIG. 15, at the high pressure loss.

As shown in FIGS. 16 and 17, inlet tube 20 is divided into first inlet tube 201 and second inlet tube 202 in holder 20*a*. First inlet tube 201 is connected to third chamber 11*c* and second inlet tube 202 is connected to fourth chamber 11*d* through electromagnetic valve 202*a*, which is normally closed. Outlet tube 21 is likewise divided into first outlet tube 211 and second outlet tube 212 through three-way valve 22 in holder 21*a*. First outlet tube is connected to fourth chamber 11*d* and second outlet tube 212 is connected to second chamber 11*b*. Three-way valve 22 selectively communicates outlet tube 21 with first outlet tube 21; or second outlet tube 212. Both electromagnetic valve 202*a* and three-way valve 22 are operated in accordance with the external instruction.

In operation, when the pressure loss in the condenser is not large, i.e., at normal operation, electromagnetic valve 202*a* is closed and three-way valve 22 communicates first outlet tube 211 with outlet tube 21. The refrigerant flowing through inlet tube 20 flows into third chamber 11*c* through first inlet tube 201 and then flows as shown in FIG. 11. The refrigerant then flows out of outlet tube 21 through first outlet tube 211 and three-way valve 22.

Figure 18:
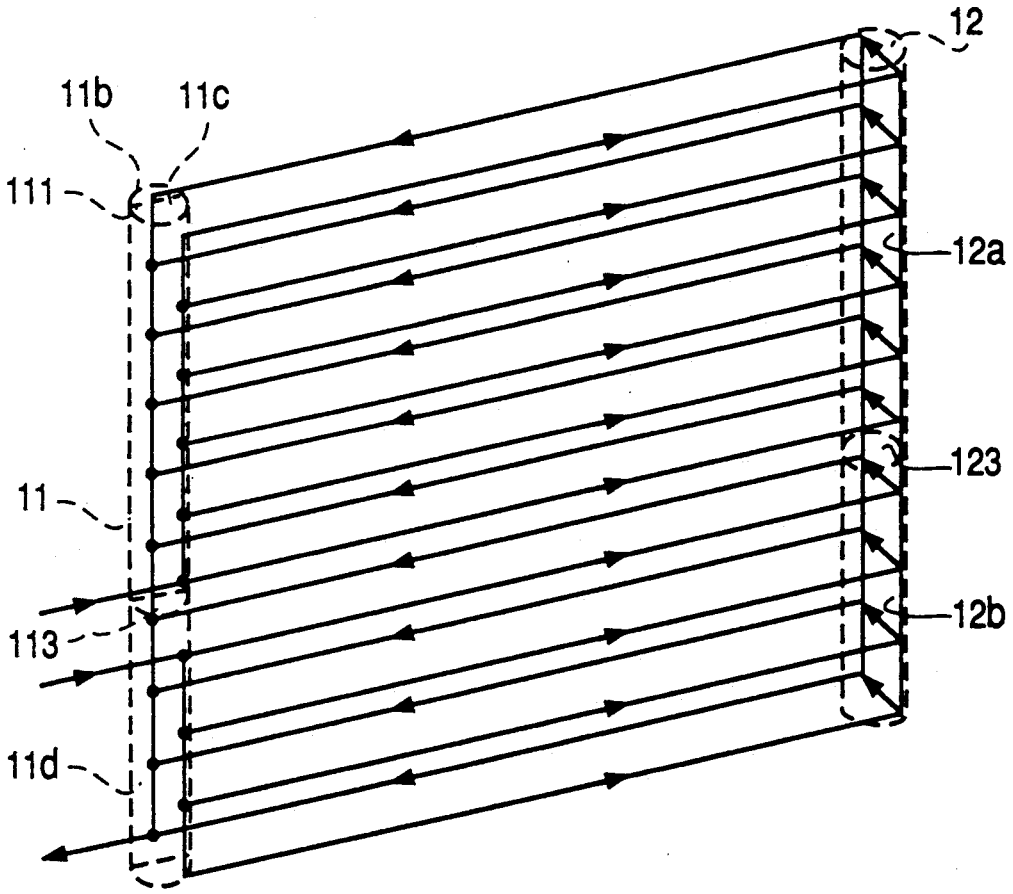
FIG. 18 is an illustrative view of the flow of the refrigerant in a condenser as shown in FIG. 15.

Alternatively, when the pressure loss in the condenser becomes large with the increase of the refrigerant pressure, electromagnetic valve 202*a* is opened and three-way valve 22 communicates second outlet tube 212 with outlet tube 21. The refrigerant flows in the condenser as shown in FIG. 18, i.e., the refrigerant flowing into inlet tube 20 is distributed into both first and second inlet tubes 201 and 202.

The refrigerant flowing through first inlet tube 201 flows into fifth chamber 12*a* through flow paths 9*a* of flat tubes 13 on the leeward side and turns around in fifth chamber 12*a*. The refrigerant flows into the upper cavity of second chamber 11*b* through flow paths 9*b* on the windward side and flows downwardly into the lower cavity of second chamber 11*b*. On the other hand, the refrigerant flowing through second inlet tube 202 flows into sixth chamber 12*b* through flow paths 9*a* of flat tubes 13 on leeward side and turns around in sixth chamber 12*b*. The refrigerant flows into the lower cavity of second chamber 11*b* through flow paths 9*b* on the windward side and merges into the previous refrigerant flowing from the upper cavity of second chamber 11*b*. The merged refrigerant flows out of second chamber 11*b* through second outlet tube 212 and three-way valve 22.

The pressure loss in the condenser increases when the length of the flow paths becomes longer, the cross-sectional area of the flow paths becomes relatively small, and the flow speed of the refrigerant becomes fast. According to the above construction, if the pressure loss in the condenser increases, since the refrigerant is distributed into two circuits, and the length of the flow paths becomes short, the pressure loss in the condenser thus decreases.

The present invention has been described in accordance with various preferred embodiments. These embodiments, however, are merely for example only, and the invention should not be construed as limited thereto. It should be apparent to those skilled in the art that other variations or modifications can be made within the scope of this invention.

I claim:

1. A heat exchanger comprising:

a pair of header pipes each defining a hollow cavity, at least one of said header pipes including at least one dividing wall extending in the longitudinal direction of said header pipe for dividing said cavity of said header pipe into at least two chambers, an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each said plurality of fluid tubes such that said plurality of fluid paths are in fluid communication with said header pipes through said slots; and a plurality of corrugated fins disposed between opposed surfaces of said fluid tubes;

wherein said dividing wall includes a plurality of cut-out portions at a position corresponding to each of said plurality of slots such that said fluid tubes may be received within said slots.

2. The heat exchanger of claim 1 wherein one of said header pipes includes one said dividing wall longitudinally dividing said cavity of said header pipe into a first chamber and a second chamber, said inlet tube is connected to one of said chambers, and said outlet tube is connected to the other of said chambers.

3. A heat exchanger comprising:

a pair of header pipes each defining a hollow cavity, at least one of said header pipes including at least one dividing wall extending in the longitudinal direction of said header pipe for dividing said cavity of said header pipe into at least two chambers;

an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each said plurality of fluid tubes such that said plurality of fluid paths are in fluid communication with said header pipes through said slots; and a plurality of corrugated fins disposed between opposed surfaces of said fluid tubes;

wherein one of said header pipes includes one said dividing wall longitudinally dividing said cavity of said header pipe into a first chamber and a second chamber, said inlet tube is connected to one of said chambers, and said outlet tube is connected to the other of said chambers; and wherein said one of said header pipes further includes a first partition wall transversely dividing one of said first and second chambers into an upper third chamber and a lower fourth chamber, said other header pipe includes a second partition wall transversely dividing said cavity thereof into an upper fifth chamber and a lower sixth chamber, said inlet tube is connected to said third chamber, and said outlet tube is connected to said fourth chamber.

4. The heat exchanger of claim 3 wherein said inlet tube is divided into a first inlet tube and a second inlet tube, said first inlet tube is connected to said third chamber, the second inlet tube is connected to said fourth chamber, said outlet tube is divided into a first outlet tube and a second outlet tube through a three-way valve for selectively communicating said outlet tube with one of said first and second outlet tubes, said first outlet tube is connected to said fourth chamber and said second outlet tube is connected to said second chamber.

5. The heat exchanger of claim 4 wherein said second inlet tube is connected to said fourth chamber through an electromagnetic valve.

6. A heat exchanger comprising:

a pair of header pipes each defining a hollow cavity, at least one of said header pipes including at least one dividing wall extending in the longitudinal direction of said header pipe for dividing said cavity of said header pipe into at least two chambers;

an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each said plurality of fluid tubes such that said plurality of fluid paths are in fluid communication with said header pipes through said slots; and a plurality of corrugated fins disposed between opposed surfaces of said fluid tubes;

wherein one of said header pipes includes a partition wall transversely dividing the cavity thereof into an upper chamber and a lower chamber and a second dividing wall extending in the longitudinal direction of said header pipe through said upper chamber and terminates at said partition wall to thereby longitudinally divide said upper chamber into a first upper chamber and a second upper chamber, said other header pipe including said dividing wall extending in a longitudinal direction of said header pipe dividing said cavity of said other header pipe into a first chamber and a second chamber, said inlet tube is connected to said first upper chamber and said outlet tube is connected to said second upper chamber.

7. A heat exchanger comprising:

a pair of header pipes each defining a hollow cavity;

an inlet tube connected to one of said header pipes;

an outlet tube connected to one of said header pipes;

a plurality of fluid tubes, each having a plurality of partition walls defining a plurality of fluid paths in fluid communication with said header pipes through said slits;

a plurality of slots longitudinally spaced on each of said header pipes for receiving a terminal end of each said plurality of fluid tubes such that said fluid tubes are thereby disposed between said header pipes; and a plurality of corrugated fins disposed between opposed surfaces of said fluid tubes;

wherein one of said header pipes includes a partition wall transversely dividing the cavity thereof into an upper chamber and a lower chamber, a dividing wall extends in the longitudinal direction of said header pipe through said upper chamber and terminates at said partition wall to thereby longitudinally divide said upper chamber into a first chamber and a second chamber, said inlet tube is connected to said first chamber, and said outlet tube is connected to said second chamber.

8. The heat exchanger of claim 3 wherein said dividing wall includes a plurality of cut-out portions at a position corresponding to each of said plurality of slots such that said fluid tubes may be received within said slots.

9. The heat exchanger of claim 4 wherein said dividing wall includes a plurality of cut-out portions at a position corresponding to each of said plurality of slots such that said fluid tubes may be received within said slots.

10. The heat exchanger of claim 6 wherein said dividing wall includes a plurality of cut-out portions at a position corresponding to each of said plurality of slots such that said fluid tubes may be received within said slots.

11. The heat exchanger of claim wherein each of said fluid tubes includes a slit at each said terminal end at a position corresponding to a side edge of said dividing wall.

12. The heat exchanger of claim 2 wherein each of said fluid tubes includes a slit at each said terminal end at a position corresponding to a side edge of said dividing wall.

13. The heat exchanger of claims 3 wherein each of said fluid tubes includes a slit at each said terminal end at a position corresponding to a side edge of said dividing wall.

14. The heat exchanger of claim 4 wherein each of said fluid tubes includes a slit at each said terminal end at a position corresponding to a side edge of said dividing wall.

15. The heat exchanger of claim 6 wherein each of said fluid tubes includes a slit at each said terminal end at a position corresponding to a side edge of said dividing wall.

16. A heat exchanger comprising:

a pair of header pipes each defining a hollow cavity, at least one of said header pipes including at least one dividing wall extending in the longitudinal direction of said header pipe for dividing said cavity of said header pipe into at least two chambers;

an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each of said plurality of fluid tubes such that said plurality of fluid paths are in fluid communication with said header pipes through said slots; and a plurality of corrugated fins disposed between opposed surfaces of said fluid tubes;

wherein one of said partition walls dividing said fluid tubes is disposed at a position generally corresponding to that of said dividing wall and has a greater thickness than that of said dividing wall.

17. The heat exchanger of claim 2 wherein one of said partition walls dividing said fluid tubes is disposed at a position generally corresponding to that of said dividing wall and has a greater thickness than that of said dividing wall.

18. The heat exchanger of claim 3 wherein one of said partition walls dividing said fluid tubes is disposed at a position generally corresponding to that of said dividing wall and has a greater thickness than that of said dividing wall.

19. The heat exchanger of claim 4 wherein one of said partition walls dividing said fluid tubes is disposed at a position generally corresponding to that of said dividing wall and has a greater thickness than that of said dividing wall.

20. The heat exchanger of claim 6 wherein one of said partition walls dividing said fluid tubes is disposed at a position generally corresponding to that of said dividing wall and has a greater thickness than that of said dividing wall.

21. The heat exchanger of claim 1 wherein said fluid paths disposed on a leeward side of said dividing wall have a greater cross-sectional area than those on a windward side thereof.

22. The heat exchanger of claim 2 wherein said fluid paths disposed on a leeward side of said dividing wall have a greater cross-sectional area than those on a windward side thereof.

23. The heat exchanger of claim 1 wherein said fluid paths disposed on a leeward side of said dividing wall have a greater cross-sectional area than those on a windward side thereof.

24. The heat exchanger of claim 4 wherein said fluid paths disposed on a leeward side of said dividing wall have a greater cross-sectional area than those on a windward side thereof.

25. The heat exchanger of claim 6 wherein said fluid paths disposed on a leeward side of said dividing wall have a greater cross-sectional area than those on a windward side thereof.

26. The heat exchanger of claim 1 wherein one of said header pipes is formed by said dividing wall being disposed within said hollow cavity and welded at an interior surface of said header pipe.

27. The heat exchanger of claim 1 wherein one of said header pipes and said dividing wall are integrally formed by a formation process.

28. A heat exchanger comprising:

a pair of header pipes each defining a hollow cavity, at least one of said header pipes including at least one dividing wall extending in the longitudinal direction of said header pipe for dividing said cavity of said header pipe into at least two chambers;

an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each of said plurality of fluid tubes such that said plurality of fluid paths are in fluid communication with said header pipes through said slots; and a plurality of corrugated fins disposed between opposed surfaces of said fluid tubes;

wherein said header pipe and said dividing wall are formed from a single piece of header pipe material, said header pipe material is bent in a generally circular shape to form said hollow cavity, a first end of said material is bent inwardly of the circular shape and welded to an opposed side of the circular shape such that said dividing wall is formed, and a second end of said material is bent inwardly of the circular shape alongside of said dividing wall and terminates a short distance thereafter, said second end is welded to a peripheral surface of said dividing wall.

29. The heat exchanger of claim 28 wherein said dividing wall includes a step-like portion and said second end of said material is disposed within and welded to a concave portion of said step-like portion.

30. A heat exchanger comprising:

a pair of header pipes each defining a hollow cavity, at least one of said header pipes including at least one dividing wall extending in the longitudinal direction of said header pipe for dividing said cavity of said header pipe into at least two chambers;

an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each of said plurality of fluid tubes such that said plurality of fluid paths are in fluid communication with said header pipes through said slots; and a plurality of corrugated fins disposed between opposed surfaces of said fluid tubes;

wherein said header pipe and said dividing wall are formed from a single piece of header pipe material, said header pipe material is bent in a generally circular shape to form said hollow cavity, a first end of said material is bent inwardly of the circular shape and welded to an opposed side of the circular shape such that said dividing wall is formed, and a second end of said material wraps around and overlays said circular shape slightly past the bend of said material which forms said dividing wall and is welded to an outer surface of said circular shape.

31. A heat exchanger comprising:

a pair of header pipes each defining a hollow cavity, at least one of said header pipes including at least one dividing wall extending in the longitudinal direction of said header pipe for dividing said cavity of said header pipe into at least two chambers;

an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each of said plurality of fluid tubes such that said plurality of fluid paths are in fluid communication with said header pipes through said slots; and a plurality of corrugated fins disposed between opposed surfaces of said fluid tubes;

wherein said header pipe and said dividing wall are formed from a single piece of header pipe material, said header pipe material is bent in a generally circular shape to form said hollow cavity, a first end of said material is bent inwardly of the circular shape and welded to an opposed side of the circular shape such that said dividing wall is provided, a second end of said material is bent inwardly of the circular shape alongside of said dividing wall and is welded to an opposed side of the circular shape, said first and second ends are welded together such that said dividing wall is formed by both said first and second ends.

32. A heat exchanger comprising:

a pair of header pipes each defining a hollow cavity, at least one of said header pipes including at least one dividing wall extending in the longitudinal direction of said header pipe for dividing said cavity of said header pipe into at least two chambers;

an inlet tube connected to one of said header pipes;

an outlet tube connected to one of said header pipes;

a plurality of fluid tubes, each having a plurality of partition walls defining a plurality of fluid paths;

a plurality of slots longitudinally spaced on each of said header pipes for receiving a terminal end of each of said plurality of fluid tubes such that said plurality of fluid paths are in fluid communication with said header pipes through said slots; and a plurality of corrugated fins disposed between opposed surfaces of said fluid tubes;

wherein said fluid paths disposed on a leeward side of said dividing wall have a greater cross-sectional area than those on a windward side thereof, said fluid paths being interconnected with each other via said header pipes to form a flow passage between said inlet tube and said outlet tube.

33. The heat exchanger of claim 32 wherein one of said header pipes includes one said dividing wall longitudinally dividing said cavity of said header pipe into a first chamber and a second chamber, said inlet tube is connected to one of said chambers, and said outlet tube is connected to the other of said chambers.

34. The heat exchanger of claim 32 wherein each of said fluid tubes includes a slit at each said terminal end at a position corresponding to a side edge of said dividing wall.

35. The heat exchanger of claim 32 wherein each of said fluid tubes includes a slit at each said terminal end at a position corresponding to a side edge of said dividing wall.

36. The heat exchanger of claim 32 wherein one of said header pipes is formed by said dividing wall being disposed within said hollow cavity and welded at an interior surface of said header pipe.

37. The heat exchanger of claim 32 wherein one of said header pipes and said dividing wall are integrally formed by a formation process.

* * * * *